US010945088B2

(12) United States Patent
Kobayashi et al.

(10) Patent No.: US 10,945,088 B2
(45) Date of Patent: Mar. 9, 2021

(54) SOUND REPRODUCING APPARATUS CAPABLE OF SELF DIAGNOSTIC AND SELF-DIAGNOSTIC METHOD FOR A SOUND REPRODUCING APPARATUS

(71) Applicant: ASAHI KASEI KABUSHIKI KAISHA, Tokyo (JP)

(72) Inventors: Shiro Kobayashi, Menlo Park, CA (US); Masaya Yamashita, Tokyo (JP); Takeshi Ishii, Tokyo (JP); Soichi Mejima, New York, NY (US)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/432,064

(22) Filed: Jun. 5, 2019

(65) Prior Publication Data

US 2020/0389746 A1 Dec. 10, 2020

(51) Int. Cl.

| | |
|---|---|
| ***H04R 29/00*** | (2006.01) |
| ***H04R 1/40*** | (2006.01) |
| ***G08B 21/18*** | (2006.01) |
| ***H04R 3/12*** | (2006.01) |

(52) U.S. Cl.

CPC ..... *H04R 29/002* (2013.01); *G08B 21/18* (2013.01); *H04R 1/403* (2013.01); *H04R 3/12* (2013.01); *H04R 2217/03* (2013.01)

(58) Field of Classification Search

CPC ..... H04R 29/002; H04R 1/403; H04R 3/12; H04R 2217/03; H04R 29/00; H04R 29/001

USPC ..... 381/56–59, 77–82

See application file for complete search history.

(56) References Cited

U.S. PATENT DOCUMENTS

| | | | | |
|---|---|---|---|---|
| 8,594,350 | B2 * | 11/2013 | Hooley | H04S 7/301 381/307 |
| 9,330,673 | B2 * | 5/2016 | Cho | H04R 1/406 |
| 9,392,389 | B2 | 7/2016 | Hall et al. | |
| 9,431,980 | B2 * | 8/2016 | Popova | H03G 3/20 |
| 9,602,916 | B2 | 3/2017 | Asada | |
| 2006/0153391 | A1 * | 7/2006 | Hooley | H04S 7/301 381/17 |
| 2010/0272270 | A1 * | 10/2010 | Chaikin | H04R 29/001 381/59 |

(Continued)

FOREIGN PATENT DOCUMENTS

| | | | |
|---|---|---|---|
| JP | H05150792 | A | 6/1993 |
| JP | 2009111833 | A | 5/2009 |

(Continued)

*Primary Examiner* — Disler Paul

(74) *Attorney, Agent, or Firm* — Kenja IP Law PC

(57) ABSTRACT

A sound reproducing apparatus capable of self-diagnostic. The apparatus includes a directional speaker emitting ultrasound waves to a target object, an information acquisition unit configured to acquire a sound from the target object and optionally an image of the target object, and a processor electrically connected with the directional speaker and the information acquisition unit. The processor drives the directional speaker to emit the ultrasound waves to the target object and diagnoses a failure of the directional speaker based on the sound acquired by the information acquisition unit. A self-diagnostic method for a sound reproducing apparatus having a directional speaker is also provided.

6 Claims, 6 Drawing Sheets

(56) References Cited

U.S. PATENT DOCUMENTS

| | | | | |
|---|---|---|---|---|
| 2011/0129101 | A1* | 6/2011 | Hooley | H04R 3/005 381/92 |
| 2013/0058503 | A1 | 3/2013 | Kato et al. | |
| 2014/0269207 | A1* | 9/2014 | Baym | H04R 3/12 367/138 |
| 2015/0346845 | A1 | 12/2015 | Di Censo et al. | |
| 2017/0164099 | A1* | 6/2017 | Shintani | H04R 1/345 |

FOREIGN PATENT DOCUMENTS

| | | | |
|---|---|---|---|
| JP | 2013057705 | A | 3/2013 |
| JP | 2013251751 | A | 12/2013 |
| JP | 2017191967 | A | 10/2017 |
| JP | 2018107678 | A | 7/2018 |
| WO | 2018016432 | A1 | 1/2018 |

* cited by examiner

*FIG.2*

| Target Object | Positional Information |
|---|---|
| Current | Pos_A |
| Potential 1 | Pos_B |
| Potential 2 | Pos_C |
| Potential 3 | Pos_D |

SOUND REPRODUCING APPARATUS CAPABLE OF SELF DIAGNOSTIC AND SELF-DIAGNOSTIC METHOD FOR A SOUND REPRODUCING APPARATUS

TECHNICAL FIELD

The present disclosure relates to a sound reproducing apparatus having a directional speaker capable of self-diagnostic and a self-diagnostic method for a sound reproducing apparatus having a directional speaker.

BACKGROUND

A sound reproducing apparatus having a directional speaker, also known as parametric acoustic arrays, has been used in many practical audio applications. The directional speaker uses ultrasound waves to transmit audio in a directed beam of sound. Ultrasound waves have much smaller wavelengths than regular audible sound and thus the directional speaker becomes much more directional than traditional loudspeakers. For example, U.S. Pat. No. 9,392,389 discloses a system for providing an audio notification containing personal information to a specific person via a directional speaker.

These conventional systems have been used in exhibitions, galleries, museums, and the like to provide audio information that is audible only to a specific person in a limited area.

SUMMARY

To maximize its acoustic field, the directional speaker of the sound reproducing apparatus is often mounted on a ceiling or at a high location on a wall, which make it difficult to access the speaker. Therefore, it is preferable that a diagnostic of the sound reproducing apparatus to determine a failure of the directional speaker can be performed without physically accessing to it. Moreover, ultrasound waves emitted from the directional speaker are high pitched beyond human hearing, and turns to an audible sound when a beam of the ultrasound waves strike a surface of a target object. The audible sound can be heard within a very limited area. This makes the diagnostic of the sound reproducing apparatus even more difficult as compared to a diagnostic of traditional loudspeakers that can be simply tested by hearing a sound reproduced from the speakers. Furthermore, if the beam of the ultrasound waves is misoriented, the audible sound is not reproduced at the intended area and/or the volume of the audible sound is lower than intended.

It is, therefore, an object of the present disclosure to provide a sound reproducing apparatus having a directional speaker capable of self-diagnostic and a self-diagnostic method for a sound reproducing apparatus having a directional speaker which can remotely perform a diagnosis of the directional speaker without physically accessing thereto.

In order to achieve the object, one aspect of the present disclosure is a sound reproducing apparatus capable of self-diagnostic, comprising:

a directional speaker emitting ultrasound waves to a target object;

an information acquisition unit configured to acquire a sound from the target object; and a processor electrically connected with the directional speaker and the information acquisition unit, wherein the processor determines an existence of a target object from the image acquired by the information acquisition unit, and if the target object exists, the processor drives the directional speaker to emit the ultrasound waves to the target object and diagnoses a failure of the directional speaker based on the sound acquired by the information acquisition unit.

Another aspect of the present disclosure is a self-diagnostic method for a sound reproducing apparatus having a directional speaker, comprising:

emitting ultrasound waves from a directional speaker to a target object;

measuring a level of a sound radiated from the target object based; and diagnosing a failure of the directional speaker based on the measured level of the sound radiated from the target object.

According to the sound reproducing apparatus capable of self-diagnostic and the self-diagnostic method for a sound reproducing apparatus having a directional speaker, it is possible to remotely perform a diagnosis of the directional speaker without physically accessing thereto.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 2 shows an example of a database table of the sound reproducing apparatus according to an embodiment of the present disclosure;

DETAILED DESCRIPTION

Figure 1:
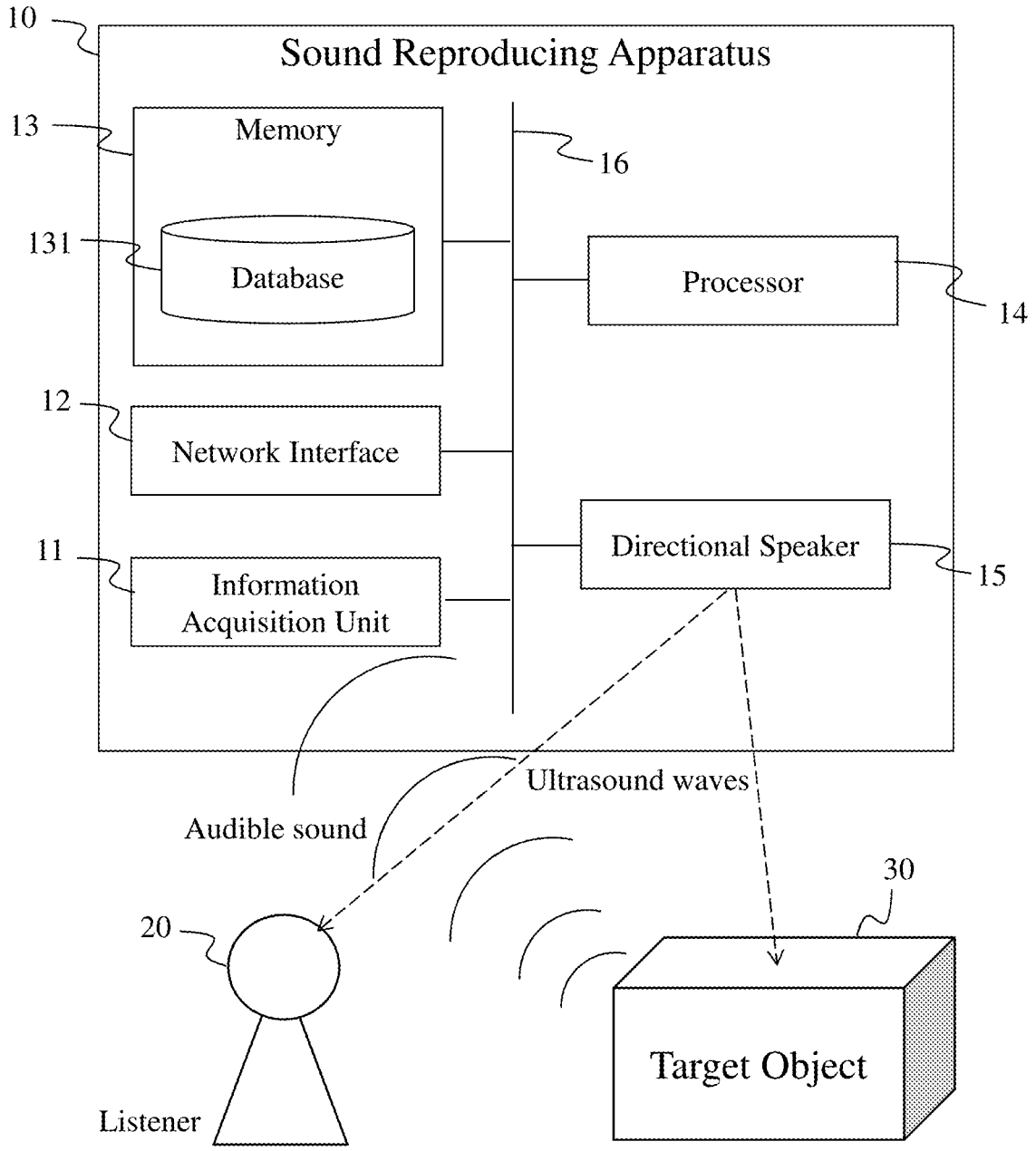
FIG. 1 is a schematic diagram of a sound reproducing apparatus according to an embodiment of the present disclosure.

Embodiments will now be described with reference to the drawings. FIG. 1 is a schematic diagram of a sound reproducing apparatus 10 capable of self-diagnostic according to an embodiment of the present disclosure.

The sound reproducing apparatus 10 includes an information acquisition unit 11, a processor 14, and a directional speaker 15 which are electrically connected with each other via a bus 16. In this embodiment, the sound reproducing apparatus 10 further include a network interface 12, and a memory 13, which are not essential for the present disclosure.

The information acquisition unit 11 acquires a sound radiated from a target object. To this end, the information acquisition unit 11 may have a microphone such as an omnidirectional microphone and a directional microphone. Optionally, the information acquisition unit 11 also acquire an image of a target area in which the target object is supposed to locate. To this end, the information acquisition unit 11 may include a camera such as a 2D camera, a 3D camera, and an infrared camera, and captures the image at a predetermined screen resolution and a predetermined frame rate. The captured image is transmitted to the processor 14 via the bus 16. The predetermined screen resolution is, for example, full high-definition (FHD; 1920*1080 pixels), but may be another resolution as long as the captured image is appropriate to the subsequent image recognition processing. The predetermined frame rate may be, but not limited to, 30 fps.

The network interface 12 includes a communication module that connects the sound reproducing apparatus 10 to a network. The network is not limited to a particular communication network and may include any communication network including, for example, a mobile communication network and the internet. The network interface 12 may include a communication module compatible with mobile communication standards such as 4th Generation (4G) and 5th Generation (5G). The communication network may be an ad hoc network, a local area network (LAN), a metropolitan area network (MAN), a wireless personal area network (WPAN), a public switched telephone network (PSTN), a terrestrial wireless network, an optical network, or any combination thereof.

The memory 13 includes, for example, a semiconductor memory, a magnetic memory, or an optical memory. The memory 13 is not particularly limited to these, and may include any of long-term storage, short-term storage, volatile, non-volatile and other memories. Further, the number of memory modules serving as the memory 13 and the type of medium on which information is stored are not limited. The memory may function as, for example, a main storage device, a supplemental storage device, or a cache memory. The memory 13 also stores any information used for the operation of the sound reproducing apparatus 10. For example, the memory 13 may store a system program, an application program, images captured by the information acquisition unit 11, sound data to be reproduced by the directional speaker 15 and so on. The information stored in the memory 13 may be updatable by, for example, information acquired from an external device by the network interface 12.

The processor 14 may be, but not limited to, a general-purpose processor or a dedicated processor specialized for a specific process. The processor 14 includes a microprocessor, a central processing unit (CPU), an application specific integrated circuit (ASIC), a digital signal processor (DSP), a programmable logic device (PLD), a field programmable gate array (FPGA), a controller, a microcontroller, and any combination thereof. The processor 14 controls the overall operation of the sound reproducing apparatus 10.

The directional speaker 15 emits ultrasound waves to a listener 20 and/or a target object 30. The target object 30 may be any object including goods for sale such as food products, beverages, household products, clothes, cosmetics, home appliances, and medicines, and advertising materials such as signages, billboards and banners. When the listener or the target object is hit by the ultrasound waves, it reflects the ultrasound waves to generate an audible sound. The directional speaker 15 may include an array of ultrasound transducers to implement a parametric array. The parametric array consists of a plurality of ultrasound transducers and amplitude-modulates the ultrasound waves based on the desired audible sound. Each transducer projects a narrow beam of modulated ultrasound waves at high energy level to substantially change the speed of sound in the air that it passes through. The air within the beam behaves nonlinearly and extracts the modulation signal from the ultrasound waves, resulting in the audible sound appearing from the surface of the target object which the beam strikes. This allows a beam of sound to be projected over a long distance and to be heard only within a limited area. The beam direction of the directional speaker 15 may be adjusted by controlling the parametric array and/or actuating the orientation/attitude of the directional speaker 15.

The memory 13 may also store a database 131. The database 131 includes a table containing potential target objects and their positional information. An example of the database 131 is shown in FIG. 2. In FIG. 2, each of the potential target objects A-D is associated with coordinates "Pos_A", "Pos_B", "Pos_C", and "Pos_D", respectively of the positional information. The positional information includes information required to specify the position coordinates of the potential target objects. The processor 14 thus can look up the table of the database 131 and specify the position of the target object in the image acquired by the information acquisition unit 11. The database 131 may be updated by, for example, information acquired from an external device via the network interface 12. For example, when actual positions of one or more of the potential target objects have been changed or a new potential target object is added, the processor 14 updates the table of the database 131 based on the information acquired from the external device via the network interface 12.

Figure 3:
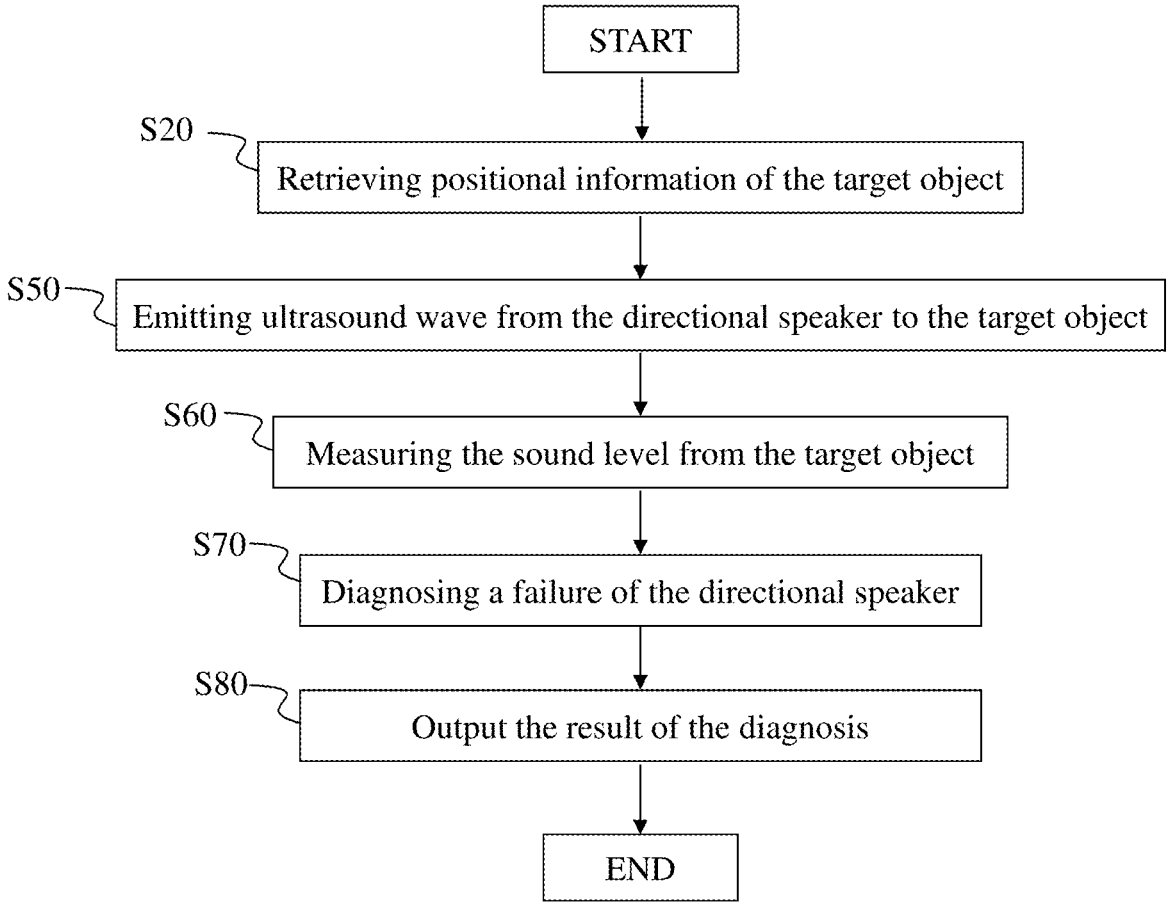
FIG. 3 is a flowchart showing steps in an operation of the sound reproducing apparatus according to an embodiment of the present disclosure.

Referring now to FIG. 3, the operation of the sound reproducing apparatus 10 will be discussed.

At the step S20, the processor 14 retrieves positional information of the target object 30 from the memory 13.

At step S50, the processor 14 adjusts the beam direction of the directional speaker 15 based on the positional information of the target object and sends a command to the directional speaker 15 so as to emit a beam of ultrasound waves to the target object.

If the beam direction is properly oriented, the target object generates an audible sound upon being hit by the beam. The information acquisition unit 11 collects the sound from the target object and sends the sound information to the processor 14 via the bus 16. The processor 14 measures, at step S60, a level of the sound based on the sound information from the information acquisition unit 11.

At step S70, the processor 14 diagnoses a failure of the directional speaker 15 based on the sound level measured at step S60. For example, when the beam direction is misoriented or the directional speaker does not emit the beam of ultrasound waves, the sound level is lower than a given threshold level. Then, the processor 14 determines the directional speaker 15 being in failure. Otherwise, the processor 14 determines that the directional speaker 15 is in good condition.

The processor 14 output the result of the diagnosis. For example, the result is transmitted to a server via the network interface 12. Alternatively, the result may be displayed on a screen or indicated by lamps. In this way, the failure of the directional speaker is notified to an operator.

Figure 4:
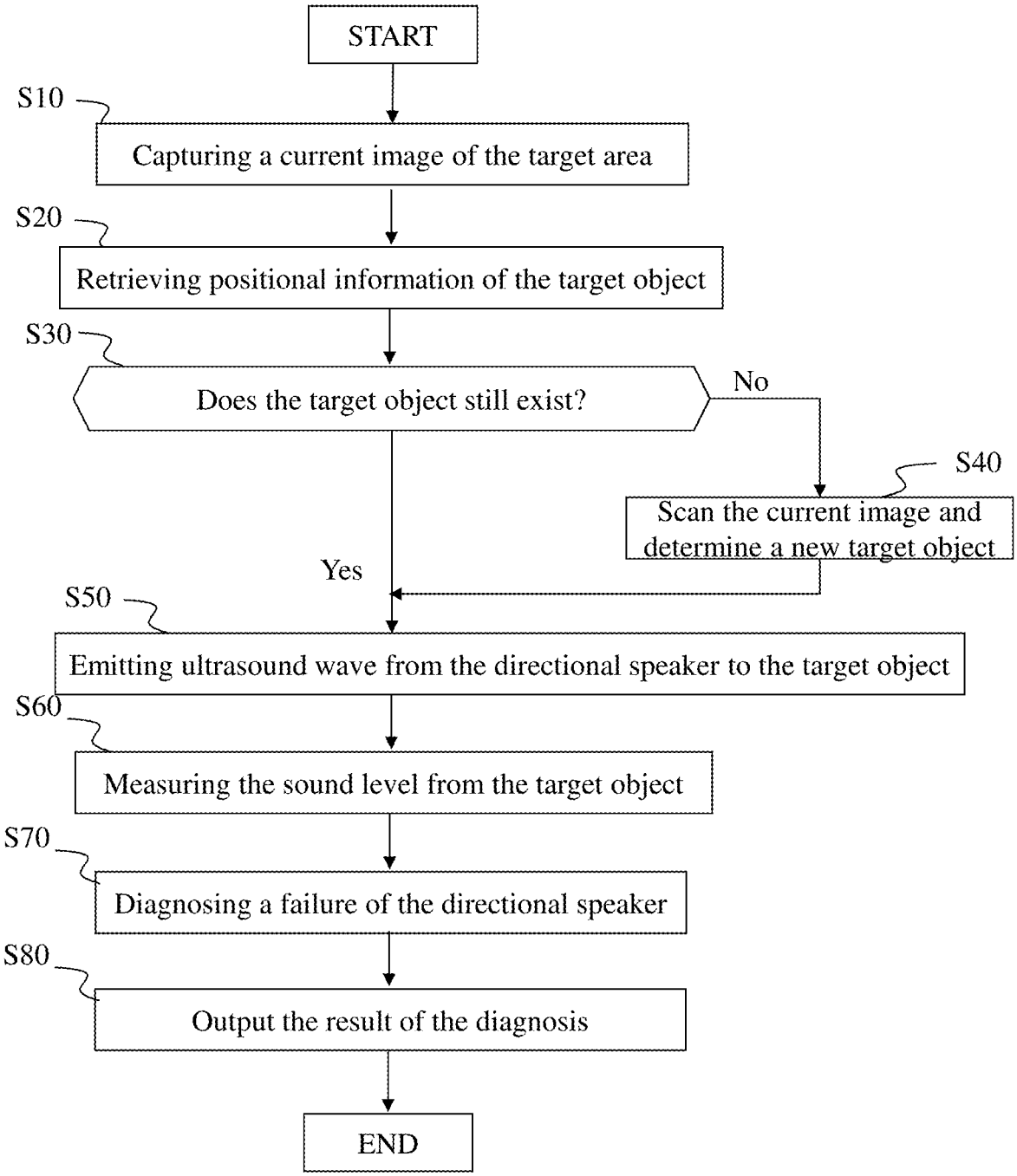
FIG. 4 is a flowchart showing steps in an operation of the sound reproducing apparatus according to another embodiment of the present disclosure.

Referring now to FIG. 4, the operation of the sound reproducing apparatus 10 of an embodiment using an image of the target object will be discussed.

At the step S10, the information acquisition unit 11 captures an image (current image) of the target area in which the target object 30 lies. The captured current image is transmitted to the processor 14.

The processor 14 retrieves, at step S20, positional information of the target object 30 from the memory 13. If the memory 13 stores the database 131, the processor 14 looks up the table of the database 131 and reads out the position of the target object 30. Alternatively, an image previously captured by the information acquisition unit and stored in the memory can be used as the positional information of the target object 30.

Then, the processor 14 determines whether the target object 30 exists in the current image at step S30. For example, the processor 14 performs an image recognition processing on the current image at the position of the target object 30 read out from the table of the database 131 and determines an existence of the target object 30. As the image recognition processing, various image recognition methods that have been proposed in the art may be used. For example, the processor 14 may analyze the image information by an image recognition method based on machine learning such as a neural network or deep learning. Data used in the image recognition processing may be stored in the memory 13. Alternatively, data used in the image recognition processing may be stored in a storage of an external device (hereinafter referred simply as the "external device") accessible via the network interface 12 of the sound reproducing apparatus 10.

The image recognition processing may be performed on the external device. Also, the determination of the existence of the target object may be performed on the external device. In these cases, the processor 14 transmits the current image to the external device via the network interface 12, and a result of the determination is transmitted back from the external device to the processor 14 via the network interface 12.

If the processor 14 detects the target object 30 in the current image, the operation proceeds to step S50. If the processor 14 does not detect the target object 30 in the current image, the processor 14 determines a new target object at step S40. Specifically, the processor 14 retrieves the positional information of the 1st potential target object from the table of the database 131. Then, the processor 14 scans the current image to detect the 1st target object. If the 1st potential target object still exists at the position of record, the processor 14 determines the 1st potential target object as the new target option and the operation proceeds to step S50. If the 1st potential target object does not exist, the processor 14 retrieves the positional information of the next potential target object and check if the potential target object still exists at the position of record. The processor 14 repeats this procedure until one of the potential target objects is identified in the current image. The identified potential target object is determined as the new target object.

At step S50, the processor 14 adjusts the beam direction of the directional speaker 15 based on the positional information of the target object and sends a command to the directional speaker 15 so as to emit a beam of ultrasound waves to the target object.

Upon being hit by the beam, the target object generates an audible sound. The information acquisition unit 11 collects the sound from the target object and sends the sound information to the processor 14 via the bus 16. The processor 14 measures, at step S60, a level of the sound based on the sound information from the information acquisition unit 11.

At step S70, the processor 14 diagnoses a failure of the directional speaker 15 based on the sound level measured at step S60. For example, when the sound level is lower than a given threshold level, the processor 14 determines the directional speaker 15 being in failure. Otherwise, the processor 14 determines that the directional speaker 15 is in good condition.

The processor 14 output the result of the diagnosis. For example, the result is transmitted to a server via the network interface 12. Alternatively, the result may be displayed on a screen or indicated by lamps. In this way, the failure of the directional speaker is notified to an operator.

This embodiment is particularly advantageous when there is a possibility that the target object is moved from the position stored in the memory.

Figure 5:
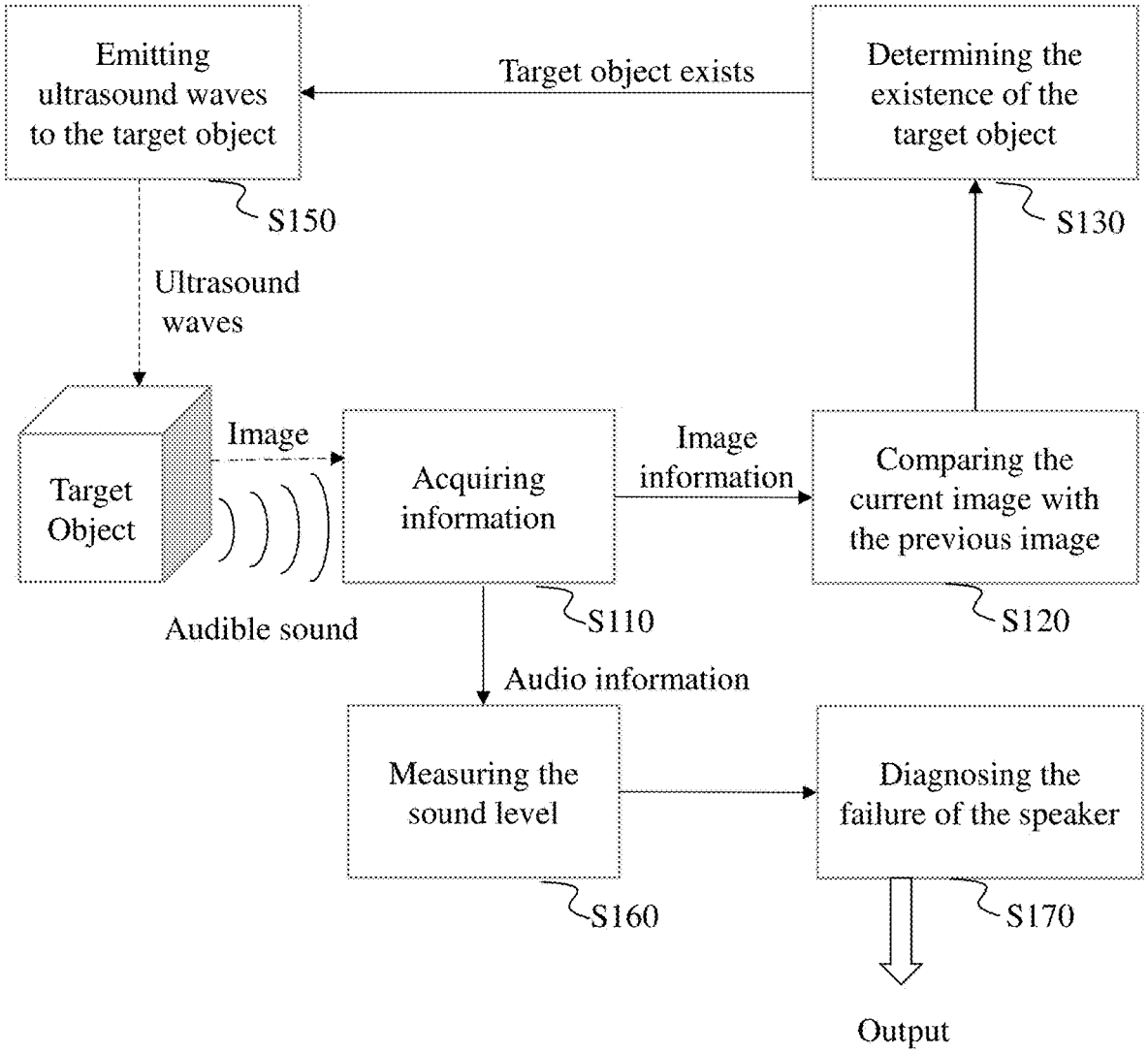
FIG. 5 is a diagram showing a general flow of a first operation mode of the sound reproducing apparatus shown in FIG. 4.
Figure 6:
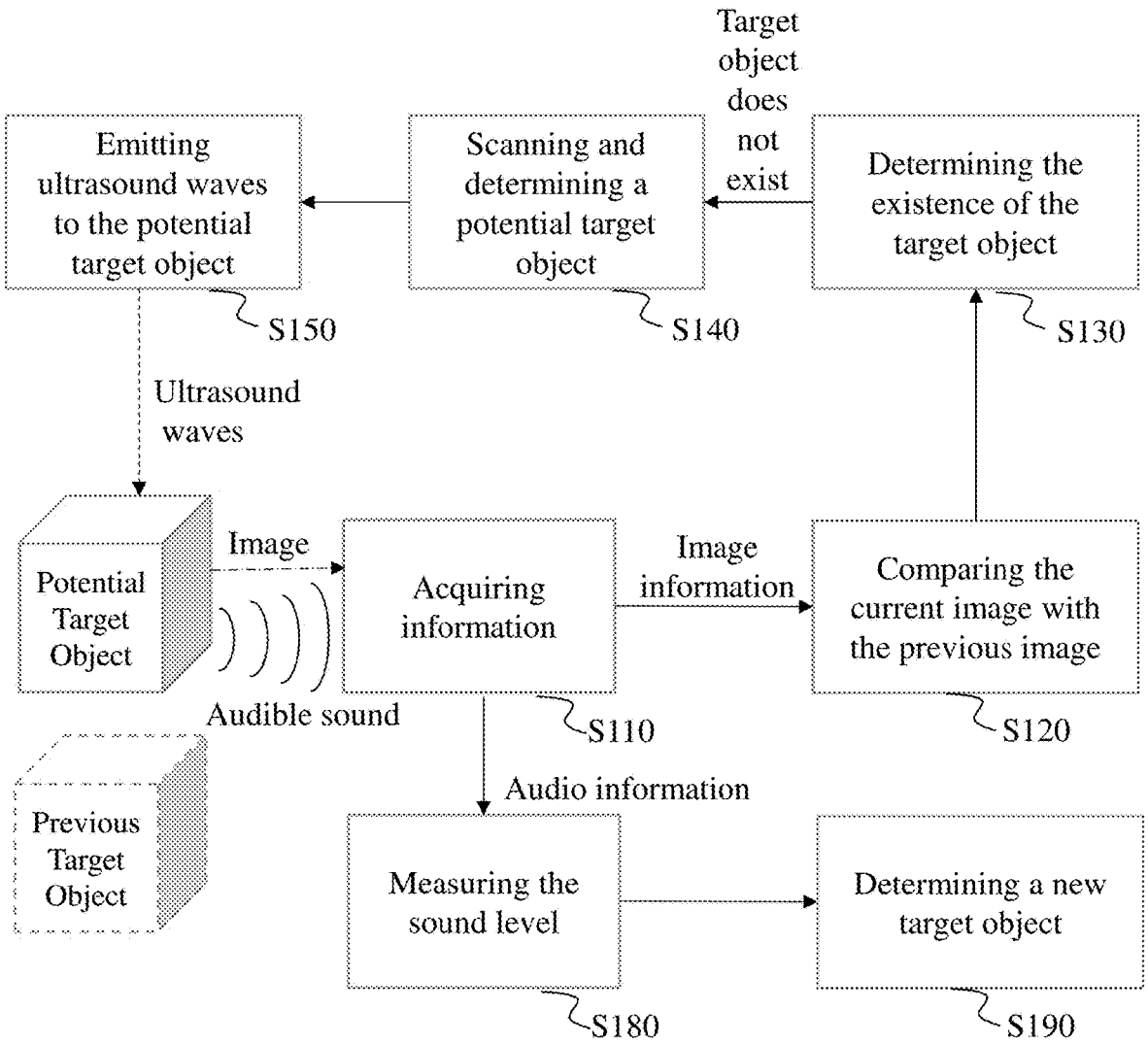
FIG. 6 is a diagram showing a general flow of a second operation mode of the sound reproducing apparatus shown in FIG. 4.

FIGS. 5 and 6 are block diagrams of the sound reproducing apparatus according to another embodiment of the present disclosure.

First, the information acquisition unit 11 captures a current image of the target area in which the target object 30 is supposed to locate. The information acquisition unit 11 transmits image information containing the current image to the processor 14 via the bus 16 (S110).

The processor 14 retrieves a previous image of the target area from the memory 13 and compares the current image with the previous image to determine whether the target object 30 still exists in the current image (S120). If the target object 30 previously identified in the previous image is identified in the current image by, for example, an image recognition, the processor determines that the target object 30 exists (S130). The previous image in the memory may be replaced by the current image.

The processor 14 adjusts the beam direction of the directional speaker 15 based on the positional information of the target object and sends a command to the directional speaker 15 so as to emit a beam of ultrasound waves to the target object (S150).

Upon being hit by the beam, the target object generates an audible sound. The information acquisition unit 11 measures a level of the sound radiated from the target object (S160). The level of the sound is transmitted to the processor 14 via the bus 16.

Based on the level of the sound radiated from the target object, the processor 14 diagnoses a failure of the directional speaker 15. For example, when the sound level is lower than a given threshold level, the processor 14 determines the directional speaker 15 being in failure. Otherwise, the processor 14 determines that the directional speaker 15 is in good condition (S170).

Then, the result of the diagnosis is output to, for example, the external server via the network interface 12. Alternatively, the sound reproducing apparatus has a display unit and/or an alarm unit such as a lamp and a buzzer and the failure of the directional speaker is notified to an operator via the display unit and/or the alarm unit.

Referring now to FIG. 6, a procedure to determine a new target object is discussed. When the target object 30 is not identified in the current image, the processor determines the target object 30 does not exist (S130). Then, the processor 14 determines the new target object. For example, the processor 14 scans the current image to detect a potential target object having a sufficient flat surface area (S140). When the potential target object is detected, the processor 14 adjusts the beam direction of the directional speaker 15 and sends a command to the directional speaker 15 so as to emit a beam of ultrasound waves to the potential target object (S150).

Upon being hit by the beam, the potential target object generates an audible sound. The information acquisition unit 11 measures a level of the sound radiated from the potential target object (S180). The level of the sound is transmitted to the processor 14 via the bus 16.

Based on the level of the sound radiated from the potential target object, the processor 14 determines if the potential target object can be used to diagnose a failure of the directional speaker 15. For example, when the sound level is higher that a given threshold level, the processor 14 determines the potential target object as the new target object (S190). Otherwise, the scanning the current image (S140) and the emitting ultrasound waves (S150) are repeated.

The image and information such as the location and size of the target object stored in the memory are updated to the current image and those of the new target object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution.

For example, the above-discussed embodiments may be stored in computer readable non-transitory storage medium as a series of operations or a program related to the operations that is executed by a computer system or other hardware capable of executing the program. The computer system as used herein includes a general-purpose computer, a personal computer, a dedicated computer, a workstation, a PCS (Personal Communications System), a mobile (cellular) telephone, a smart phone, an RFID receiver, a laptop computer, a tablet computer and any other programmable data processing device. In addition, the operations may be performed by a dedicated circuit implementing the program codes, a logic block or a program module executed by one or more processors, or the like. Further, the sound reproducing apparatus 10 including the network interface 12 has been described. However, the network interface 12 can be removed and the sound reproducing apparatus 10 may be configured as a standalone apparatus.

The actual scope of the protection sought is intended to be defined in the following claims when viewed in their proper perspective based on the prior art.

The invention claimed is:

1. A sound reproducing apparatus capable of self-diagnostic, comprising:

a directional speaker emitting ultrasound waves to a target object;

an information acquisition unit configured to acquire an image of the target object and a sound from the target object;

a processor electrically connected with the directional speaker and the information acquisition unit;

at least one of an external device, a display unit and an alarm unit; and a memory storing an image of the target area previously acquired by the information acquisition unit, wherein the processor compares the image acquired by the information acquisition unit with the image stored in the memory to determine an existence and non-existence of a target object having a flat surface area from the image acquired by the information acquisition unit, and wherein when the existence of the target object is detected, the processor drives the directional speaker to emit the ultrasound waves to the target object, diagnoses a failure of the directional speaker based on the sound acquired by the information acquisition unit, and outputs the result of the diagnosis of the failure of the directional speaker to at least one of the external device, the display unit and the alarm unit; and when the non-existence of the target object is detected, the processor scans the image acquired by the information acquisition unit to detect a potential target object having a sufficient flat surface area, and wherein the processor drives the directional speaker to emit the ultrasound waves to the potential target object and determines the potential target object as a new target object if a level of a sound radiated from the potential target object is higher than a given threshold level.

2. The sound reproducing apparatus according to claim 1, further comprising a database including positional information of the target object, wherein, the processor uses the positional information of the target object to determine the existence of the target object.

3. The sound reproducing apparatus according to claim 2, wherein the database further includes positional information of the potential target object, and, when the processor determines that the target object does not exists, the processor uses the image acquired by the information acquisition unit and the positional information of the potential target object and to determine a new target object.

4. A self-diagnostic method for a sound reproducing apparatus having a directional speaker, comprising:

capturing an image of an area where a target object having a flat surface area is supposed to locate;

comparing the image of the target area currently captured with an image of the target area previously captured the processor to determine an existence and non-existence of the target object; and when the existence of the target object is detected, emitting ultrasound waves from a directional speaker to a target object having a flat surface area;

measuring a level of a sound radiated from the target object;

diagnosing a failure of the directional speaker based on the measured level of the sound radiated from the target object; and outputting the result of the diagnosis of the failure of the directional speaker to at least one of an external device, a display unit and an alarm unit, and when the non-existence of the target object is detected, scanning the captured image to detect a potential target object having a sufficient flat surface area;

emitting ultrasound waves from the directional speaker to the potential target object;

measuring a level of a sound radiated from the potential target object;

determining the potential target object as a new target object if the measured level of the sound radiated from the potential target object is higher than a given threshold level.

5. The method according to claim 4, wherein when the target object is determined to not exist, positional information of the potential target object is retrieved from database and used to determine a new target object in the captured image.

6. The method according to claim 4, further comprising:

communicating with an external device via the network interface.

* * * * *